US012202652B2

(12) United States Patent
Ahmedi

(10) Patent No.: US 12,202,652 B2
(45) Date of Patent: Jan. 21, 2025

(54) SYSTEM AND METHOD FOR COOLING BEVERAGES IN RETAIL CONSUMER PACKAGING

(71) Applicant: Jasar Ahmedi, Hanover, IL (US)

(72) Inventor: Jasar Ahmedi, Hanover, IL (US)

( * ) Notice: Subject to any disclaimer, the term of this patent is extended or adjusted under 35 U.S.C. 154(b) by 394 days.

(21) Appl. No.: 17/364,577

(22) Filed: Jun. 30, 2021

(65) Prior Publication Data

US 2021/0403194 A1 Dec. 30, 2021

Related U.S. Application Data

(60) Provisional application No. 63/046,620, filed on Jun. 30, 2020.

(51) Int. Cl.

| | |
|---|---|
| ***B65D 5/355*** | (2006.01) |
| ***B65D 5/24*** | (2006.01) |
| ***B65D 81/18*** | (2006.01) |
| ***F25D 3/08*** | (2006.01) |

(52) U.S. Cl.

CPC ..... *B65D 5/0005* (2013.01); *B65D 5/241* (2013.01); *B65D 81/18* (2013.01); *F25D 3/08* (2013.01); *F25D 2303/081* (2013.01); *F25D 2303/0841* (2013.01); *F25D 2331/805* (2013.01)

(58) Field of Classification Search

CPC ..... B65D 5/0005; B65D 5/241; B65D 81/18; B65D 5/242; B65D 5/40; B65D 5/563; B65D 5/3678; F25D 3/08; F25D 2303/081; F25D 2303/0841; F25D 2331/805; B31B 2100/00; B31B 50/26; B31B 2120/302; B31B 2120/30

USPC ..... 229/101, 186, 103, 117.01, 117.05, 138, 229/117.35, 117.32, 5.84; 206/427, 206/45.29; 493/162, 128, 311; 53/468; 62/371, 457.5, 457.7

See application file for complete search history.

(56) References Cited

U.S. PATENT DOCUMENTS

| | | | | |
|---|---|---|---|---|
| 1,986,887 | A * | 1/1935 | Frieden | B65D 3/20 450/47 |
| 2,810,506 | A | 10/1957 | Kessler | |
| 5,094,359 | A * | 3/1992 | DeMars | B65D 5/0005 206/427 |
| 5,307,986 | A * | 5/1994 | Schuster | B65D 5/0005 229/101 |
| 5,495,727 | A * | 3/1996 | Strong | B65D 81/18 229/101 |
| 5,582,343 | A * | 12/1996 | Dalvey | B65D 5/42 229/101 |
| 6,523,738 | B1 * | 2/2003 | Sarne | B65D 5/0005 229/101 |
| 6,631,803 | B2 | 10/2003 | Rhodes et al. | |
| 7,717,318 | B2 * | 5/2010 | Brand | B65D 71/36 229/101 |

(Continued)

*Primary Examiner* — Christopher R Demeree

(74) *Attorney, Agent, or Firm* — Simmons Perrine Moyer Bergman PLC

(57) ABSTRACT

A method and system is disclosed which provides for cooling beverage containers in a retail consumer multiple beverage container package which includes expandable corners, movable panels, and the ability to expand the interior space in the retail consumer multiple beverage container package so as to permit introduction of ice into the retail consumer multiple beverage container package. The interior space is expanded by stretching accordion joints between panels.

2 Claims, 6 Drawing Sheets

(56) References Cited

U.S. PATENT DOCUMENTS

| | | | | |
|---|---|---|---|---|
| 7,841,512 | B2 * | 11/2010 | Westerman | B65D 5/6697 229/149 |
| 9,095,201 | B2 * | 8/2015 | Simonsen | A45C 7/0022 |
| 9,113,648 | B2 | 8/2015 | Burke | |
| 9,212,842 | B2 * | 12/2015 | Vasbinder | B65D 5/242 |
| 9,938,035 | B2 * | 4/2018 | Block | B65D 25/30 |
| 10,246,213 | B2 * | 4/2019 | Ayerst | B65D 5/54 |
| 11,214,428 | B2 * | 1/2022 | Costanzo, Jr. | B65D 5/241 |
| 11,535,420 | B2 * | 12/2022 | Prior | B65D 5/563 |
| 2007/0284424 | A1 | 12/2007 | Holley | |

* cited by examiner

SYSTEM AND METHOD FOR COOLING BEVERAGES IN RETAIL CONSUMER PACKAGING

CROSS REFERENCE TO RELATED APPLICATIONS

This application is a non-provisional patent application which claims the benefit of the provisional patent application having Ser. No. 63/046,620, which was filed on Jun. 30, 2020; which provisional application is incorporated herein in its entirety by this reference.

FIELD OF THE INVENTION

The present invention generally relates to packaging for beverages that are often consumed chilled.

BACKGROUND OF THE INVENTION

In the past, it has been proposed to use the cases in which the beverage packaging is sold to function as a cooler for holding ice next to the beverage. The following are examples of such systems: U.S. Pat. Nos. 9,113,648, 2,810,506, US20070284424, and U.S. Pat. No. 6,631,803.

While these beverage case patents have been known for many years, there are still needs to make improvements in this field.

SUMMARY OF THE INVENTION

It is an object of the present invention to provide an efficient and easy method and system for chilling beverages after removal from the store shelf.

It is a feature of the present invention to utilize accordion expansion joints.

It is an advantage of the present invention to provide for increased ability to surround the beverage cans with ice.

It is yet another feature of the present invention to provide and make the package waterproof.

It is another advantage to allow for efficiently maintaining cool solids and liquids in proximity to the beverage cans.

The present invention is an apparatus and method for efficiently and cost effectively providing a compact container for firmly holding beverages therein for transportation from the brewery, to the store, and to the final destination, which allows for quick and easy ability to expand the free-space in the container to facilitate retention of ice in close proximity to many surfaces of each beverage container therein.

Accordingly, the present invention is a method of cooling a package of beverage containers comprising the steps of:

- obtaining a plurality of beverage containers in a retail consumer multiple beverage container package having a first planar side panel 110, a second planar side panel 120, a third planar side panel 130, a fourth planar side panel 140 and four expandable corners;
- expanding the four expandable corners of the retail consumer multiple beverage container package to create a larger space inside the retail consumer multiple beverage container package; and
- adding inside the larger space inside the retail consumer multiple beverage container package, solid matter having a current exterior temperature lower than a current exterior temperature of said plurality of beverage containers.

Additionally, the present invention is a system for containing multiple beverage containers comprising:

- a first planar side panel 110, a second planar side panel 120, a third planar side panel 130, and a fourth planar side panel 140; which are connected in a rectangular ring configuration using adhesive material; a first to third interstitial folded accordion joining member 1113, a first to fourth interstitial folded accordion joining member 1114, second to third interstitial folded accordion joining member 1213, and a second to fourth interstitial folded accordion joining member 1214.

Additionally, the present invention is a method of cooling a package of beverage containers comprising the steps of:

- obtaining a plurality of beverage containers in a retail consumer multiple beverage container package having a first planar side panel 110, a second planar side panel 120, a third planar side panel 130, a fourth planar side panel 140 and four expandable corners;
- expanding the four expandable corners of the retail consumer multiple beverage container package, to create a larger space inside the retail consumer multiple beverage container package;
- adding ice inside the larger space inside the retail consumer multiple beverage container package, wherein the step of expanding the corners further comprises pulling opposing side panels away from each other;
- wherein each of said first planar side panel, said second planar side panel, said third planar side panel and said fourth planar side panel has a bottom foldable portion which, when folded inwardly and upwardly to a perpendicular orientation with respect to an adjacent non-bottom portion, tends to create a bottom structure; wherein said bottom foldable portion is coupled to said non-bottom portion by a folded accordion joining fold, so that said bottom portion and said non-bottom portion can be both rotated and translated with respect to another; and
- wherein in said larger space inside is caused to be made into an even larger space inside by translating a bottom portion from a non-bottom portion by expanding said folded according joining fold.

BRIEF DESCRIPTION OF THE DRAWINGS

The invention may be more fully understood by reading the foregoing description of the preferred embodiments of the invention, in conjunction with the appended drawing wherein.

DETAILED DESCRIPTION

Although described with particular reference to cardboard, the package can be implemented in many different types of materials.

The details below should be viewed as examples of many potential variations of the present invention which are protected hereunder.

Throughout this discussion, it should be understood that the beverage containers may be cans (as shown) or bottles, boxes, pouches or any suitable container for beverages.

Throughout this discussion, it should be understood that a multiple beverage container package could be a six pack (as shown) or a 12 pack, 24 pack or any number of beverage containers.

Figure 1:
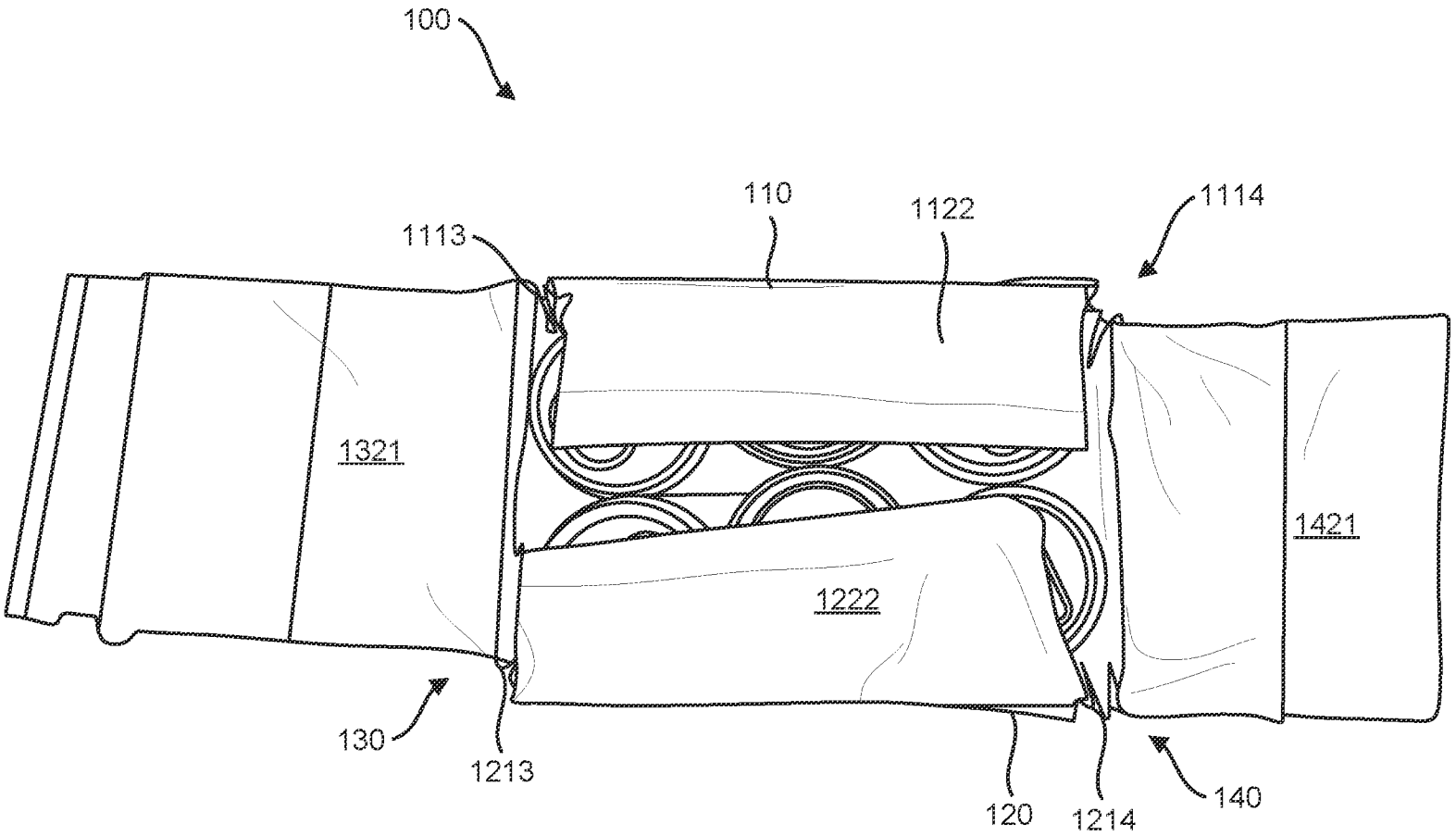
FIG. 1 is a top partially open view of a system of the present invention.

Now referring to the Figures, where like numerals refer to like matter throughout, and more particular to FIG. 1, there is shown a top partially open view of an interstitially expandable beverage container package 100 of the present invention showing beverage cans therein and formed by a first planar side panel 110, a second planar side panel 120, a third planar side panel 130, and a fourth planar side panel 140. These side panels may be made of cardboard as shown and any of the following other materials: plastic, aluminum or suitable substitutes, and may be connected by a first to third interstitial folded accordion joining member 1113, a first to fourth interstitial folded accordion joining member 1114, second to third interstitial folded accordion joining member 1213, and a second to fourth interstitial folded accordion joining member 1214. These accordion joining members may be made of cardboard, paper, fabric, plastic, aluminum, or suitable substitutes or may be non-accordion joining members which are stretchable, such as nylon, plastic, rubber or suitable substitutes. The joining members irrespective of style or material are coupled to said planar side panels with any suitable means that will allow applying sufficient force to expand the joining members without separating the joining members from the planar panels. In some embodiments, the planar side panels and the adjacent joining members may be part of a single piece of material, thereby eliminating the need for any attachment means and any need for a material to create a watertight seal at the interface between said planar side panels and said joining members.

In any configuration, it is desirable that the space inside the interstitially expandable beverage container package 100 is water tight after it has been expanded.

With first side panel pivotable top portion 1120 being partially opened, only the first side panel pivotable top portion exterior surface 1122 is visible. Similarly, with the second side panel pivotable top portion 1220 only partially open, only the second side panel pivotable top portion exterior surface 1222 is visible. Contrastingly, with the third side panel pivotable top portion 1320 being fully open, only the third side panel pivotable top portion interior surface 1321 is visible and the same is true for fourth side panel pivotable top portion interior surface 1421.

Figure 2:
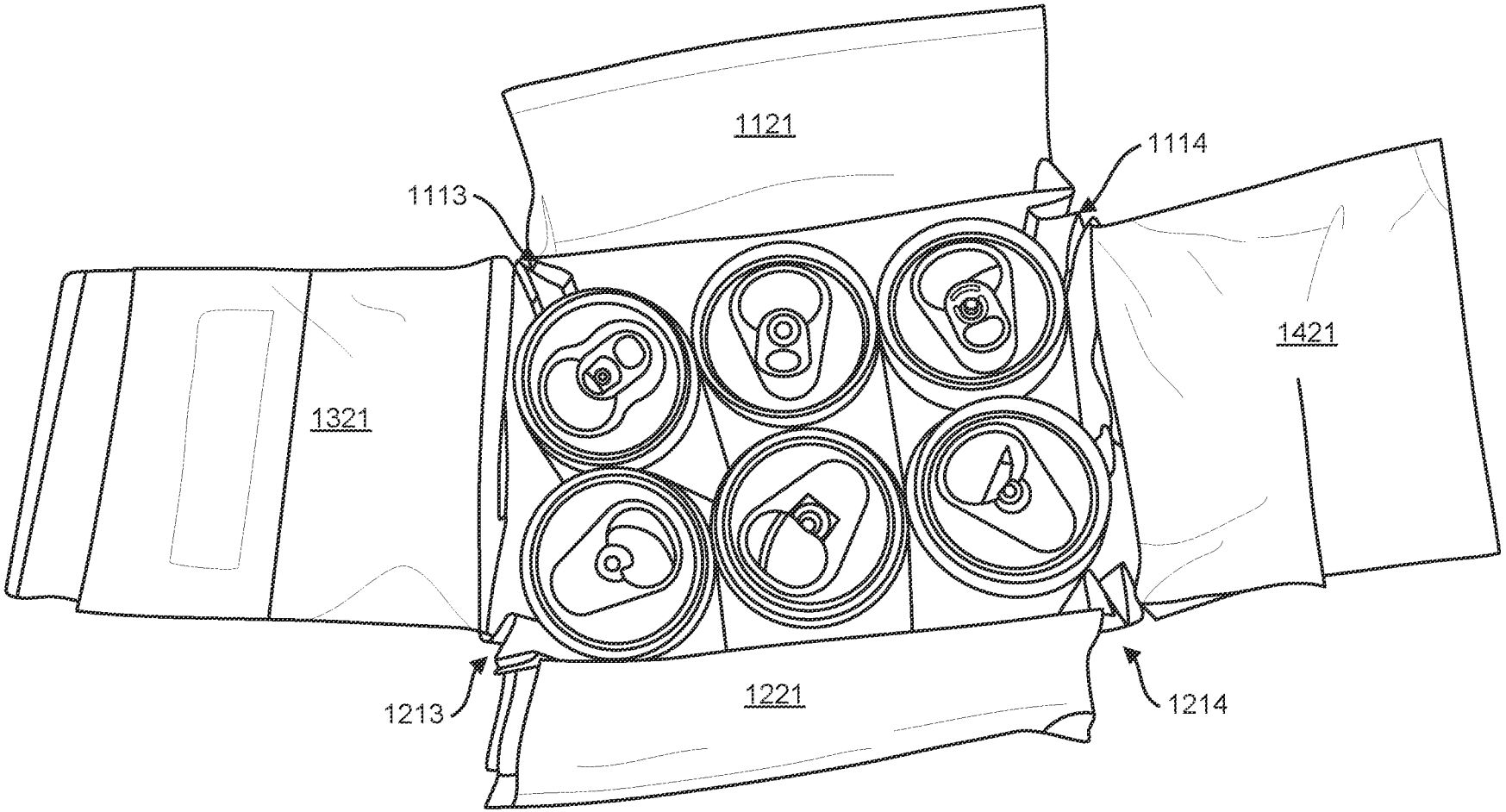
FIG. 2 is a top fully open view of system shown in FIG. 1

A better understanding of the invention can be obtained by now referring to FIG. 2 where the interstitially expandable beverage container package 100 is in a fully open configuration, which makes it easier to see the top ends of first to third interstitial folded accordion joining member 1113, first to fourth interstitial folded accordion joining member 1114, second to third interstitial folded accordion joining member 1213, and second to fourth interstitial folded accordion joining member 1214. In FIG. 2, fourth planar side panel 140 has been slightly pulled away from third planar side panel 130 and first to fourth interstitial folded accordion joining member 1114 and second to fourth interstitial folded accordion joining member 1214 are slightly expanded.

Figure 3:
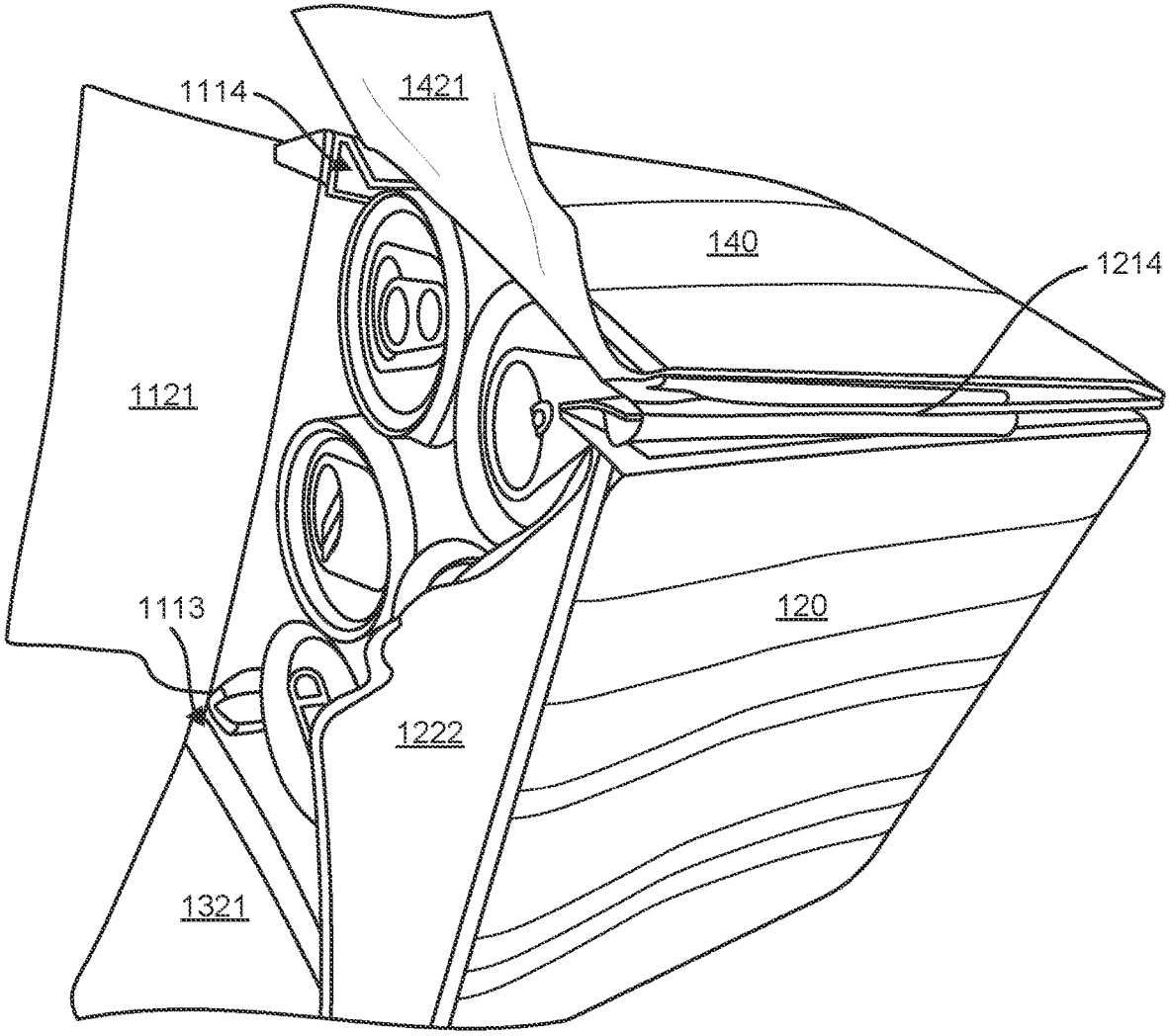
FIG. 3 is a perspective view of the system of FIGS. 1 and 2 with one corner slightly expanded.

Now referring to FIG. 3, there is shown the interstitially expandable beverage container package 100 in the configuration, as shown in FIG. 2, from a lower perspective which shows that the second to fourth interstitial folded accordion joining member 1214 is partially expanded.

Figure 4:
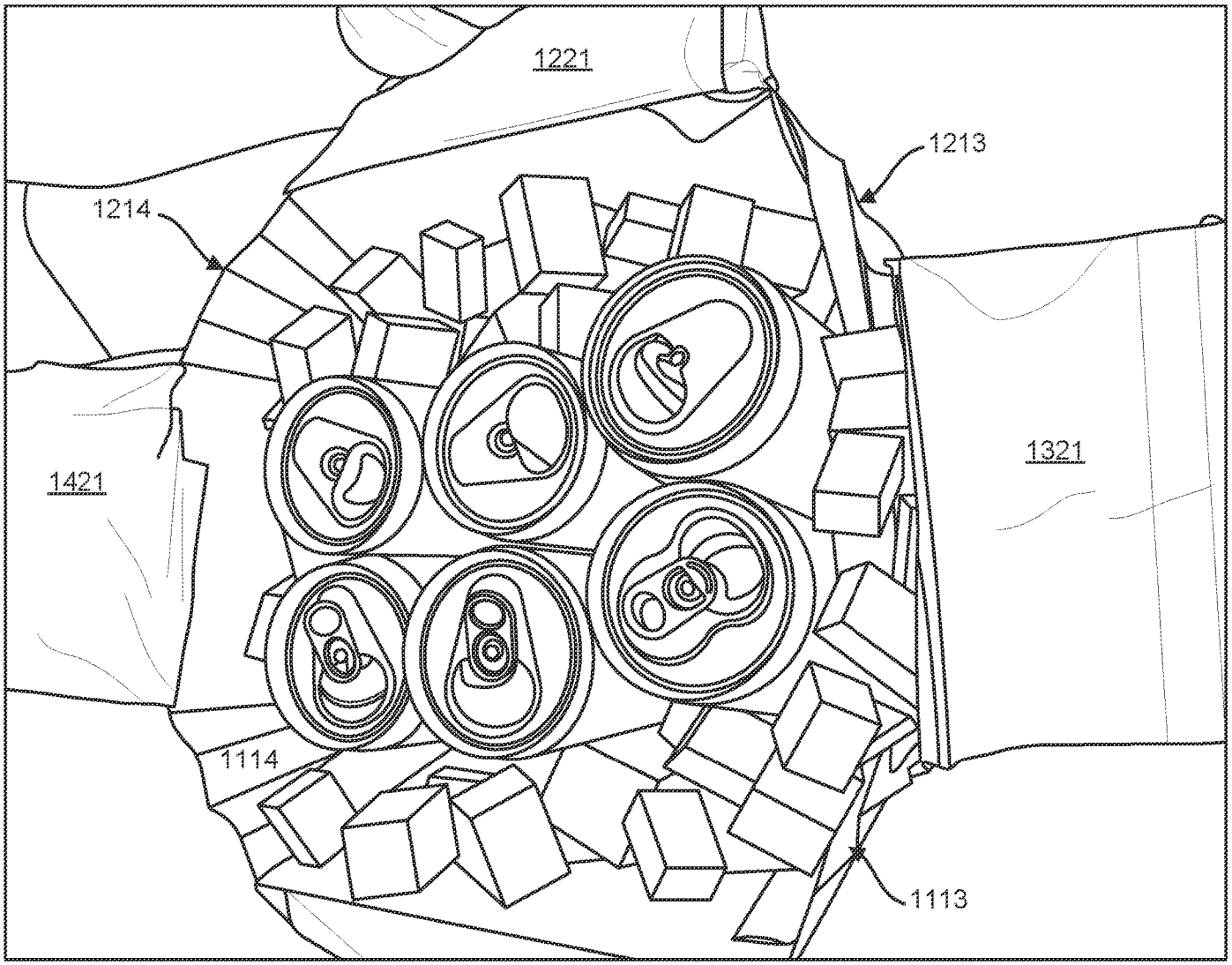
FIG. 4 is a perspective view of the system of FIGS. 1-3 where all corners are fully expanded and ice is placed inside.

Now referring to FIG. 4, there is shown the interstitially expandable beverage container package 100 in a fully deployed configuration with the ice disposed in the increased volume, which results from separating third planar side panel 130 and fourth planar side panel 140 to their optimal separation. Similarly, first planar side panel 110 and second planar side panel 120 are also optimally separated. It can be seen that each of the first to third interstitial folded accordion joining member 1113, first to fourth interstitial folded accordion joining member 1114, second to third interstitial folded accordion joining member 1213, and second to fourth interstitial folded accordion joining member 1214 are optimally expanded.

Figure 5:
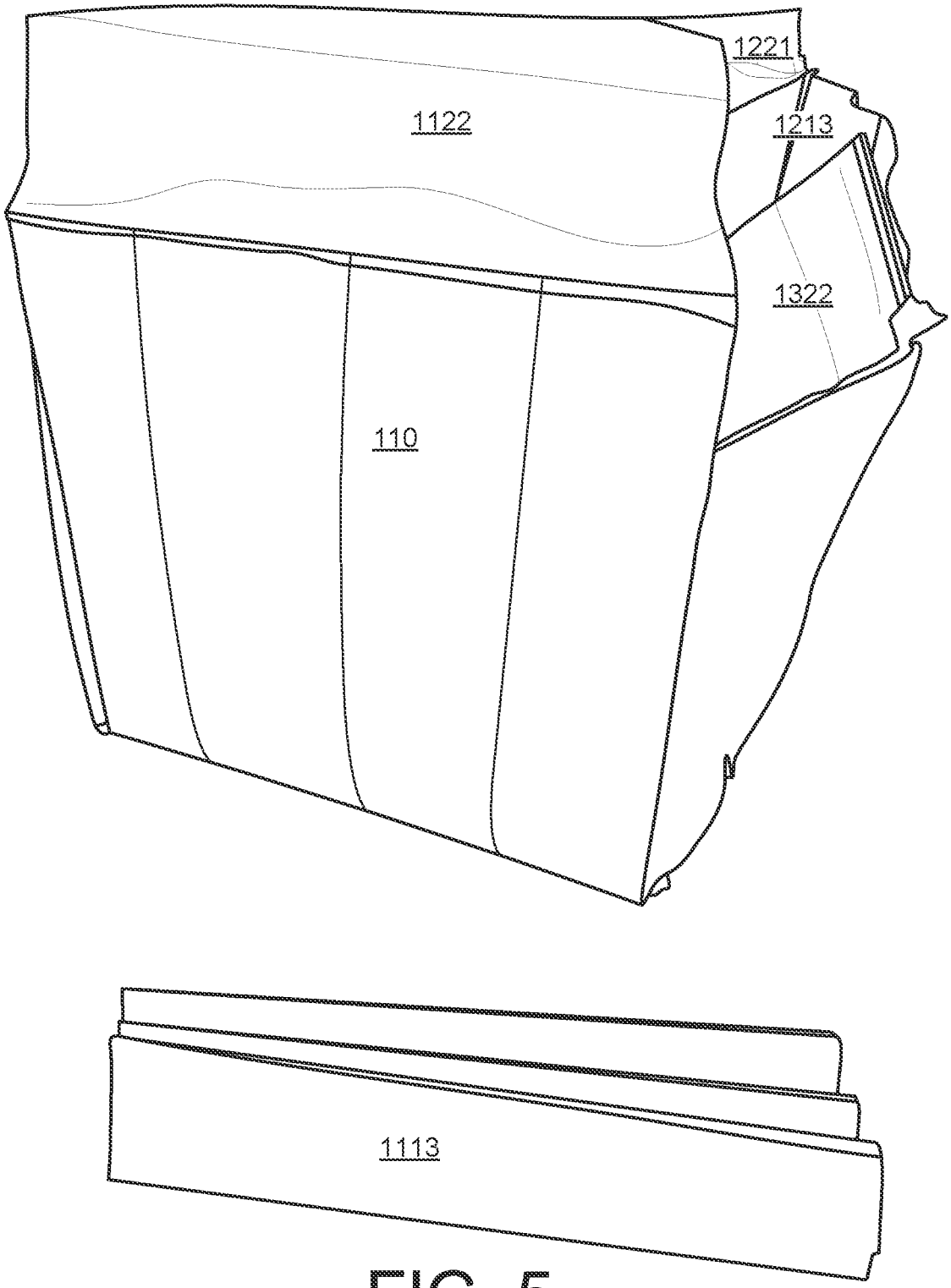
FIG. 5 is perspective view of the system of FIGS. 1-4 in a partially disassembled state.

Now referring to FIG. 5, there is shown the interstitially expandable beverage container package 100 in a partially dismantled configuration to aid in the understanding of how this embodiment of the present invention is constructed. First to third interstitial folded accordion joining member 1113 is shown as having been removed from attachment to first planar side panel 110 and third planar side panel 130. In this prototype model, tape was used to hold the first to third interstitial folded accordion joining member 1113 to each of the first planar side panel 110 and third planar side panel 130. A more preferred embodiment of interstitially expandable beverage container package 100 might have first to third interstitial folded accordion joining member 1113 attached directly with glue or other adhesive. The first planar side panel 110, as are the others, are shown as cardboard as might be typically used in a normal non-expandable beverage package. In a more preferred embodiment of the present invention, the cardboard may be coated with some water repellent material, such as wax, latex, plastic, rubber or any suitable substitute to best meet the need of any particular application. For example, once a box is formed with a bottom and four sides, the internal surfaces could be sprayed with a latex or other coating which will expand when the planar side panels are moved apart from each other and from a central portion of the bottom portion. Numerous other methods could be used, such as lining the interior portion of the interstitially expandable beverage container package 100 with aluminum foil, plastic, or suitable substitutes.

Figure 6:
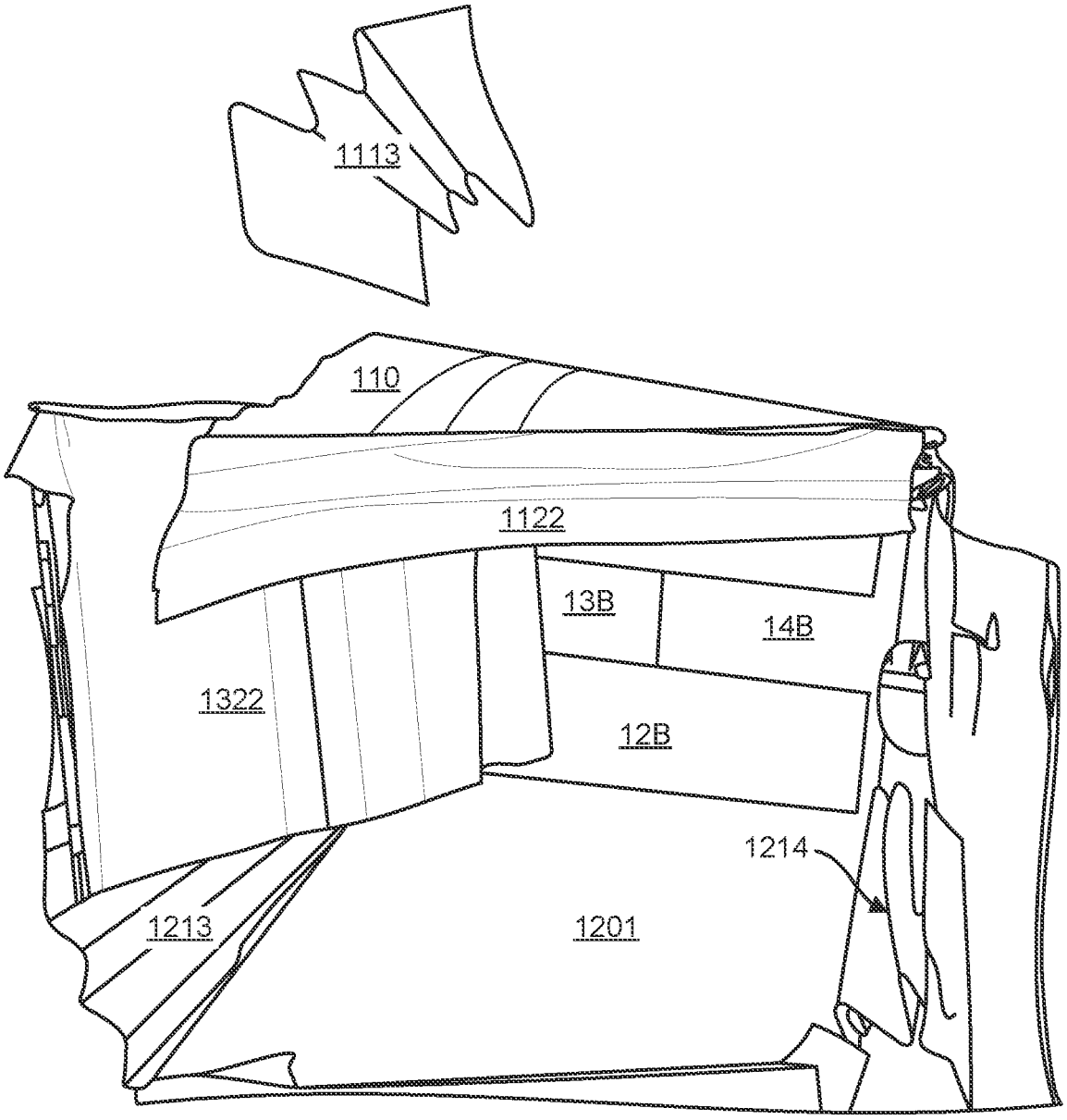
FIG. 6 is an upper perspective view of the system shown in FIG. 5.

Now referring to FIG. 6, there is shown the interstitially expandable beverage container package 100 in a configuration similar to FIG. 5, which shows how a bottom portion may be constructed. There is shown a second side panel pivotable bottom portion 12B of second planar side panel 120, a third side panel pivotable bottom portion 13B of third planar side panel 130 and a fourth side panel pivotable bottom portion 14B of fourth planar side panel 140. Occluded from view by first side panel pivotable top portion exterior surface 1122 would be a portion similar to second side panel pivotable bottom portion 12B but instead being a part of first planar side panel 110. Numerous bottom configurations could be used depending upon the particular need of any particular desired embodiment of the present invention.

The present invention also includes an innovative method of cooling a package of beverage containers comprising the steps of:

providing a multiple beverage container package having expandable corners;

expanding the corners of the multiple beverage container package, by pulling opposing side panels away from each other to create a larger space inside the multiple beverage container package; and adding ice inside the expanded multiple beverage container package.

It is believed that a person skilled in the art, after reading the innovative concepts disclosed herein would be able to make and use the present invention as described herein and various modifications of what is described herein. It is intended that the present invention include such modifications.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A method of cooling a package of beverage containers comprising the steps of:

obtaining a plurality of beverage containers in a retail consumer multiple beverage container package having a first planar side panel, a second planar side panel, a third planar side panel, a fourth planar side panel and four expandable corners;

performing a two-stage expansion, wherein a first stage of said two stage expansion includes the steps of:

expanding the four expandable corners of the retail consumer multiple beverage container package, to create a larger space inside the retail consumer multiple beverage container package;

adding ice inside the larger space inside the retail consumer multiple beverage container package, wherein the step of expanding the corners further comprises pulling opposing side panels away from each other;

wherein each of said first planar side panel, said second planar side panel, said third planar side panel and said fourth planar side panel has a bottom foldable portion which, when folded inwardly and upwardly to a perpendicular orientation with respect to an adjacent non-bottom portion, creates a bottom structure; wherein said bottom foldable portion is coupled to said non-bottom portion by a folded accordion joining fold, so that said bottom portion and said non-bottom portion can be both rotated and translated with respect to another;

wherein said larger space inside is caused to be made into an even larger space inside by performing a second stage of said two-stage expansion which includes a step of translating a bottom portion from a non-bottom portion by expanding said folded accordion joining fold;

wherein said four expandable corners comprise: a first to third interstitial folded accordion joining member, a first to fourth interstitial folded accordion joining member, second to third interstitial folded accordion joining member, and a second to fourth interstitial folded accordion joining member;

wherein once a box is formed with a bottom, and four sides internal surfaces therein are coated with latex which will expand when planar side panels are moved thereby making the retail consumer multiple beverage container package waterproof; and wherein said latex is applied by spraying.

2. The method of claim 1:

wherein each of said first planar side panel, said second planar side panel, said third planar side panel and said fourth planar side panel has a bottom foldable portion which, when folded inwardly and upwardly to a perpendicular orientation with respect to an adjacent non-bottom portion, tends to create a bottom structure; and wherein said first to third interstitial folded accordion joining member, said first to fourth interstitial folded accordion joining member, said second to third interstitial folded accordion joining member, and said second to fourth interstitial folded accordion joining member are made of cardboard and have adhesive matter thereon.

* * * * *